US009555655B2

(12) United States Patent
Sugiura et al.

(10) Patent No.: US 9,555,655 B2
(45) Date of Patent: Jan. 31, 2017

(54) RECORDING MEDIUM

(71) Applicant: CANON KABUSHIKI KAISHA, Tokyo (JP)

(72) Inventors: Takashi Sugiura, Yokohama (JP); Ryo Taguri, Sagamihara (JP); Arika Tanaka, Yokohama (JP); Tomokazu Kotake, Tokyo (JP); Takatoshi Tanaka, Tokyo (JP); Jun Wang, Yokohama (JP)

(73) Assignee: Canon Kabushiki Kaisha, Tokyo (JP)

( * ) Notice: Subject to any disclaimer, the term of this patent is extended or adjusted under 35 U.S.C. 154(b) by 0 days.

(21) Appl. No.: 14/860,920

(22) Filed: Sep. 22, 2015

(65) Prior Publication Data

US 2016/0082765 A1 Mar. 24, 2016

(30) Foreign Application Priority Data

Sep. 24, 2014 (JP) ..... 2014-194374

(51) Int. Cl.

*B41M 5/00* (2006.01)
*B41M 5/52* (2006.01)
*B41M 5/50* (2006.01)

(52) U.S. Cl.

CPC ..... *B41M 5/5218* (2013.01); *B41M 5/502* (2013.01); *B41M 5/506* (2013.01); *B41M 5/508* (2013.01); *B41M 5/52* (2013.01); *B41M 2205/42* (2013.01)

(58) Field of Classification Search

CPC ..... B41M 5/502; B41M 5/506; B41M 5/508; B41M 5/5218

See application file for complete search history.

(56) References Cited

U.S. PATENT DOCUMENTS

2003/0072925 A1* 4/2003 Kiyama ..... B41M 5/506 428/195.1
2003/0219553 A1* 11/2003 Graindourze ..... B41M 5/506 428/32.1
2005/0041084 A1* 2/2005 Mukherjee ..... B41M 5/502 347/105

FOREIGN PATENT DOCUMENTS

| | | | |
|---|---|---|---|
| EP | 0997314 | A1 | 5/2000 |
| EP | 1329330 | A1 | 7/2003 |
| EP | 1842687 | A1 | 10/2007 |
| EP | 2138320 | A1 | 12/2009 |
| JP | H07-232473 | A | 9/1995 |
| JP | H08-132731 | A | 5/1996 |
| JP | H09-066664 | A | 3/1997 |
| JP | H09-076628 | A | 3/1997 |
| JP | 2000037944 | A | 2/2000 |
| JP | 2002274021 | A | 9/2002 |
| JP | 2002362008 | A | 12/2002 |
| JP | 2003-291483 | A | 10/2003 |
| JP | 2005212263 | A | 8/2005 |
| JP | 2005231295 | A | 9/2005 |
| JP | 2006-062228 | A | 3/2006 |
| JP | 2006264278 | A | 10/2006 |
| JP | 2007-118529 | A | 5/2007 |
| JP | 2007-223306 | A | 9/2007 |
| JP | 2007245426 | A | 9/2007 |
| JP | 2008246983 | A | 10/2008 |
| JP | 2012-213924 | A | 11/2012 |

OTHER PUBLICATIONS

U.S. Appl. No. 14/861,418, filed Sep. 22, 2015.
U.S. Appl. No. 14/861,329, filed Sep. 22, 2015.

* cited by examiner

*Primary Examiner* — Betelhem Shewareged
(74) *Attorney, Agent, or Firm* — Canon U.S.A., Inc. IP Division

(57) ABSTRACT

A recording medium includes a substrate and a first ink-receiving layer. The first ink-receiving layer contains an amorphous silica having an average particle size of 1.0 μm or more and an inorganic particle having an average particle size of 50 nm or less. The content of the amorphous silica in the first ink-receiving layer is 30 mass % or more and 95 mass % or less based on a total content of all inorganic particles.

19 Claims, No Drawings

RECORDING MEDIUM

BACKGROUND OF THE INVENTION

Field of the Invention

The present invention relates to a recording medium.

Description of the Related Art

Among recording media used in an ink jet image recording method, recording media (matte paper) whose surface has low gloss, that is, whose surface has a good "matte appearance" have been demanded. On the other hand, if particles having a large particle size are simply added to an ink-receiving layer to achieve a good matte appearance, the binding property of the ink-receiving layer may degrade, that is, a dusting phenomenon may occur. Therefore, a method for achieving a good matte appearance and suppressing a dusting phenomenon has been demanded. Japanese Patent Laid-Open No. 2007-223306 discloses that a matte appearance is achieved by forming a layer mainly composed of a wet silica having an average secondary particle size of 1.5 to 2.5 μm on a layer mainly composed of inorganic particles having an average secondary particle size of 500 nm or less. Japanese Patent Laid-Open No. 2012-213924 discloses, as an example, a recording medium in which an ink-receiving layer containing colloidal silica, fumed silica, and wet silica is disposed on a paper substrate.

SUMMARY OF THE INVENTION

According to one aspect of the present invention, there is provided a recording medium including a substrate; and an ink-receiving layer, wherein the ink-receiving layer includes a second ink-receiving layer containing an inorganic particle having an average particle size of 50 nm or less and a first ink-receiving layer containing an amorphous silica having an average particle size of 1.0 μm or more and an inorganic particle having an average particle size of 50 nm or less, in this order from the substrate, and a content of the amorphous silica in the first ink-receiving layer is 30 mass % or more and 95 mass % or less based on a total content of all inorganic particles.

Further features of the present invention will become apparent from the following description of exemplary embodiments.

DESCRIPTION OF THE EMBODIMENTS

According to studies conducted by the present inventors, in the recording medium disclosed in Japanese Patent Laid-Open No. 2007-223306, the matte appearance is improved, but a dusting phenomenon sometimes occurs. In the recording medium disclosed in Japanese Patent Laid-Open No. 2012-213924, the matte appearance is achieved and a dusting phenomenon is suppressed to some extent, but the color development of an image formed is poor.

Accordingly, the present invention is directed to providing a recording medium which has a high degree of color development of an image formed and a matte appearance and in which a dusting phenomenon is suppressed.

Hereafter, the present invention will be described in detail using embodiments.

First, the "matte appearance" according to an embodiment of the present invention will be described. A recording medium having a matte appearance refers to a recording medium having small surface reflection and having small gloss even when viewed at any angle. More specifically, the recording medium having a matte appearance refers to a recording medium in which all the 20° glossiness, 60° glossiness, and 75° glossiness of the surface are less than 6.0%.

According to studies conducted by the present inventors, it has been found that, when a second ink-receiving layer containing inorganic particles having an average particle size of 50 nm or less and a first ink-receiving layer containing an amorphous silica having an average particle size of 1.0 μm or more and inorganic particles having an average particle size of 50 nm or less are disposed on a substrate in that order and furthermore the content of the amorphous silica in the first ink-receiving layer is 30 mass % or more and 95 mass % or less based on the total content of all inorganic particles, the dusting phenomenon can be suppressed while a high degree of color development of an image formed is achieved and a matte appearance is maintained.

In recording media including a porous ink-receiving layer containing inorganic particles, particles having a large particle size are generally used in order to achieve a matte appearance. However, an ink-receiving layer formed of such particles having a large particle size does not have sufficient transparency due to the influence of light scattering caused by the particles. When a dye ink to be fixed as a result of penetration into the ink-receiving layer is used, the color development of an image formed degrades. In other words, there is a trade-off between the color development of an image formed when a dye ink is used and the matte appearance of a recording medium. Thus, it has been found that the color development of an image can be improved without impairing the matte appearance by adding small particles having high transparency to a receiving layer in an appropriate amount. Furthermore, by inserting small particles between large particles, the adhesion between the particles is improved, which can suppress a dusting phenomenon.

It has also been found that, by disposing an ink-receiving layer (second ink-receiving layer) containing inorganic particles having an average particle size of 50 nm or less as a layer disposed on a substrate so as to be adjacent to an ink-receiving layer (first ink-receiving layer) containing an amorphous silica having an average particle size of 1.0 μm or more, a high degree of color development of an image is achieved for dye inks while a desired matte appearance is maintained.

Recording Medium

The recording medium according to an embodiment of the present invention includes a substrate and a first ink-receiving layer. A second ink-receiving layer may be disposed between the substrate and the first ink-receiving layer. The recording medium according to an embodiment of the present invention is particularly a recording medium used in an ink jet recording method, that is, an ink jet recording medium. Hereafter, each component of the recording medium according to an embodiment of the present invention will be described.

Substrate

The substrate is, for example, a substrate composed of only a base paper or a substrate including a base paper and a resin layer, that is, a substrate including a base paper coated with a resin. In an embodiment of the present invention, a substrate including a base paper and a resin layer, that is, a resin-coated substrate can be used. In this case, the resin layer may be disposed on only one surface of the base paper, but is desirably disposed on both surfaces of the base paper.

The base paper is mainly made of wood pulp and optionally contains synthetic pulp such as polypropylene and synthetic fiber such as nylon or polyester. Examples of the wood pulp include laubholz bleached kraft pulp (LBKP), laubholz bleached sulfite pulp (LBSP), nadelholz bleached kraft pulp (NBKP), nadelholz bleached sulfite pulp (NBSP), laubholz dissolving pulp (LDP), nadelholz dissolving pulp (NDP), laubholz unbleached kraft pulp (LUKP), and nadelholz unbleached kraft pulp (NUKP). They may be suitably used alone or in combination of two or more. Among the wood pulps, LBKP, NBSP, LBSP, NDP, and LDP which contain a large amount of short staple components are particularly used. The pulp is particularly a chemical pulp (sulfate pulp or sulfite pulp) containing only a small amount of impurities. A pulp whose degree of whiteness is improved by performing a bleaching treatment can also be used. The paper substrate may suitably contain a sizing agent, a white pigment, a paper strengthening agent, a fluorescent brightening agent, a water-retaining agent, a dispersant, a softening agent, and the like.

In an embodiment of the present invention, the paper density of the base paper provided in JIS P 8118 is preferably 0.6 g/cm$^3$ or more and 1.2 g/cm$^3$ or less and more preferably 0.7 g/cm$^3$ or more and 1.2 g/cm$^3$ or less.

In an embodiment of the present invention, when the substrate includes a resin layer, the thickness of the resin layer is, for example, 10 μm or more and 60 μm or less. In an embodiment of the present invention, the thickness of the resin layer is calculated by the following method. The cross-section of the recording medium is exposed by cutting the recording medium using a microtome, and the cross-section is observed with a scanning electron microscope. The thickness of the resin layer is measured at freely selected 100 points or more, and the average of the thicknesses is defined as a thickness of the resin layer. In an embodiment of the present invention, the thickness of other layers is also calculated by the same method.

A resin used for the resin layer is, for example, a thermoplastic resin. Examples of the thermoplastic resin include acrylic resin, acrylic silicone resin, polyolefin resin, and styrene-butadiene copolymers. Among them, a polyolefin resin is particularly used. In an embodiment of the present invention, the polyolefin resin refers to a polymer that uses an olefin as a monomer. Specific examples of the olefin resin include polymers and copolymers of ethylene, propylene, isobutylene, and the like. The polyolefin resins may be suitably used alone or in combination of two or more. Among them, polyethylene is particularly used. The polyethylene is, for example, a low-density polyethylene (LDPE) and a high-density polyethylene (HDPE). The resin layer may contain, for example, a white pigment, a fluorescent brightening agent, and ultramarine blue to control the opacity, the degree of whiteness, and the hue. Among them, a white pigment can be contained to improve the opacity. Examples of the white pigment include a rutile titanium oxide and an anatase titanium oxide.

In an embodiment of the present invention, the root-mean-square slope RΔq of roughness profile elements, provided in JIS B 0601:2001, of the surface of the substrate on the first ink-receiving layer side is preferably 0.1 or more and more preferably 0.3 or more. The root-mean-square slope RΔq is preferably 2.0 or less and more preferably 1.0 or less.

Ink-Receiving Layer

In an embodiment of the present invention, the ink-receiving layer may be disposed on only one surface or both surfaces of the substrate. The thickness of the ink-receiving layer is, for example, 18 μm or more and 55 μm or less. In an embodiment of the present invention, the ink-receiving layer may be constituted by a single layer or two or more layers, but it is desired that the second ink-receiving layer is disposed between the substrate and the first ink-receiving layer, and the second ink-receiving layer contains inorganic particles having an average particle size of 50 nm or less. In the description below, the first ink-receiving layer is also referred to as an upper layer and the second ink-receiving layer is also referred to as a lower layer.

In an embodiment of the present invention, the dry coating amount of the ink-receiving layer is preferably 18.0 g/m$^2$ or more and 55.0 g/m$^2$ or less and more preferably 18.0 g/m$^2$ or more and 50.0 g/m$^2$ or less. When the ink-receiving layer is constituted by a plurality of layers, the dry coating amount of the ink-receiving layer refers to a total dry coating amount of all the layers. Hereafter, materials that can be contained in the ink-receiving layer will be described.

Upper Layer: First Ink-Receiving Layer

In an embodiment of the present invention, the thickness of the first ink-receiving layer serving as an upper layer is preferably 1.0 μm or more and 30.0 μm or less and more preferably 2.0 μm or more and 20.0 μm or less. The coating amount of the first ink-receiving layer is preferably 0.5 g/m$^2$ or more and 15.0 g/m$^2$ or less and more preferably 1.0 g/m$^2$ or more and 10.0 g/m$^2$ or less.

(1) Amorphous Silica Having Average Particle Size of 1.0 μm or More

In an embodiment of the present invention, the first ink-receiving layer contains an amorphous silica having an average particle size of 1.0 μm or more. The average particle size of the amorphous silica is preferably 1.0 μm or more and 15.0 μm or less and more preferably 1.0 μm or more and 10.0 μm or less. In an embodiment of the present invention, the average particle size refers to an average of diameters of particles having a maximum unit recognized as a particle when the cross-section of the recording medium is observed with a scanning electron microscope (SEM). More specifically, the cross-section of the recording medium is observed with a scanning electron microscope (SEM), the diameters of freely selected 100 particles are measured, and the number average of the diameters is calculated. In the amorphous silica, secondary particles formed by association of primary particles are observed. Therefore, the "average particle size of the amorphous silica" refers to an "average secondary particle size of the amorphous silica". The primary particle size of the amorphous silica is preferably 1 nm or more and 80 nm or less and more preferably 2 nm or more and 70 nm or less. If the primary particle size is less than 1 nm, the ink absorbency is sometimes not sufficiently achieved. If the primary particle size is more than 80 nm, the color development is sometimes not sufficiently achieved.

In an embodiment of the present invention, the amorphous silica refers to particles containing 93% or more of $SiO_2$, about 5% or less of $Al_2O_3$, and about 5% or less of $Na_2O$ on a dry weight basis, such as so-called white carbon, silica gel, and porous synthetic amorphous silica. The production method for porous synthetic amorphous silica is classified into a dry process and a wet process, and the dry process is classified into a combustion process and a heating process. The wet process is classified into a precipitation process and a gel process. The dry combustion process is also generally called a vapor-phase process in which a mixture of vaporized silicon tetrachloride and hydrogen is subjected to combustion in the air at 1,600 to 2,000° C. The wet precipitation process is normally a process in which sodium silicate, sulfuric acid, and the like are reacted with each other in an aqueous solution to precipitate $SiO_2$. In this process, the specific surface area, primary particle size, and the like of silica can be controlled in accordance with, for example, the reaction temperature and the addition rate of an acid. The secondary particle size and the physical properties of silica subtly changes in accordance with drying and crushing conditions. The wet gel process is generally a production process in which sodium silicate and sulfuric acid are reacted with each other by simultaneous addition or the like. In the case of silica particles, for example, a three-dimensional hydrogel structure is obtained through dehydration condensation of silanol groups. The feature of the wet gel process is that secondary particles having a large specific surface area can be formed because the hydrogel structure includes relatively small primary particles. Therefore, the size of the primary particles is controlled by changing the reaction conditions or the like, and thus secondary particle sizes having different oil absorptions can be achieved. In an embodiment of the present invention, one type of amorphous silica or two types or more of amorphous silicas may be contained.

In an embodiment of the present invention, the content of the amorphous silica in the first ink-receiving layer needs to be 30 mass % or more and 95 mass % or less based on the total content of all inorganic particles. The content is preferably 55 mass % or more and 95 mass % or less and more preferably 60 mass % or more and 90 mass % or less. If the content is less than 30 mass %, a desired matte appearance is not achieved. If the content is more than 95 mass %, the binding property of the ink-receiving layer is poor and a dusting phenomenon occurs. Note that the "total content of all inorganic particles" used herein refers to a content of all inorganic particles including the amorphous silica.

(2) Inorganic Particles Having Average Particle Size of 50 nm or Less

In an embodiment of the present invention, the first ink-receiving layer contains inorganic particles having an average particle size of 50 nm or less (hereafter also simply referred to as "inorganic particles"). The average particle size of the inorganic particles is preferably 1 nm or more and 50 nm or less, more preferably 3 nm or more and 30 nm or less, and particularly preferably 5 nm or more and 20 nm or less. In an embodiment of the present invention, the "average particle size of the inorganic particles" refers to an "average primary particle size of the inorganic particles".

In an embodiment of the present invention, the inorganic particles can be used for an ink-receiving-layer-forming coating liquid while being dispersed by a dispersant. The average secondary particle size of the inorganic particles in a dispersed state is preferably 1 nm or more and 1000 nm or less, more preferably 10 nm or more and 800 nm or less, and particularly preferably 50 nm or more and 500 nm or less. The average secondary particle size of the inorganic particles in a dispersed state can be measured by a dynamic light scattering method.

Examples of the inorganic particles used in an embodiment of the present invention include alumina hydrate, alumina, silica, colloidal silica, titanium dioxide, zeolite, kaoline, talc, hydrotalcite, zinc oxide, zinc hydroxide, aluminum silicate, calcium silicate, magnesium silicate, zirconium oxide, and zirconium hydroxide. These inorganic particles may be suitably used alone or in combination of two or more. Among the inorganic particles, alumina hydrate, alumina, and silica which are capable of forming a porous structure with good ink absorbency are particularly used.

Examples of the alumina used in the ink-receiving layer include γ-alumina, α-alumina, δ-alumina, θ-alumina, and χ-alumina. Among them, γ-alumina is particularly used in terms of optical density of images and ink absorbency. Specifically, AEROXIDE Alu C (manufactured by EVONIK) and the like can be used.

An alumina hydrate represented by general formula (X): $Al_2O_{3-n}(OH)_{2n}.mH_2O$ can be suitably used for the ink-receiving layer, where n represents 0, 1, 2, or 3, m represents 0 or more and 10 or less and preferably represents 0 or more and 5 or less, and m and n do not represent 0 at the same time. Herein, $mH_2O$ often represents a water phase that does not contribute to formation of a crystal lattice and can be eliminated. Thus, m is not necessarily an integer. When the alumina hydrate is heated, m may represent 0.

In an embodiment of the present invention, the alumina hydrate can be produced by a publicly known method. Specific examples of the method include a method in which an aluminum alkoxide is hydrolyzed, a method in which sodium aluminate is hydrolyzed, and a method in which an aqueous solution of aluminum sulfate and aluminum chloride is added to an aqueous solution of sodium aluminate and neutralization is performed.

An amorphous, gibbsite, or boehmite form, which depends on heat treatment temperature, is known as a crystal structure of the alumina hydrate. Note that the crystal structure of the alumina hydrate can be analyzed by X-ray diffraction. In an embodiment of the present invention, among them, boehmite alumina hydrate or amorphous alumina hydrate is particularly used. Specific examples of the alumina hydrate include alumina hydrates disclosed in Japanese Patent Laid-Open Nos. 7-232473, 8-132731, 9-66664, and 9-76628 and commercially available alumina hydrates such as Disperal HP14 and HP18 (manufactured by Sasol Limited). These alumina hydrates may be suitably used alone or in combination of two or more.

In an embodiment of the present invention, the specific surface area of the alumina hydrate determined by a BET method is preferably 100 $m^2/g$ or more and 200 $m^2/g$ or less and more preferably 125 $m^2/g$ or more and 175 $m^2/g$ or less. The BET method is a method in which molecules and ions with a known size are caused to adsorb onto a sample surface and the specific surface area of the sample is measured from the amount of adsorption. In an embodiment of the present invention, nitrogen gas is used as a gas caused to adsorb onto a sample.

The alumina hydrate and alumina used in an embodiment of the present invention can be mixed in an ink-receiving-layer-forming coating liquid in the form of a water dispersion liquid. An acid can be used as the dispersant for the water dispersion liquid. A sulfonic acid represented by general formula (Y): $R—SO_3H$ can be used as the acid because the blur of images is suppressed, where R represents a hydrogen atom, an alkyl group having 1 to 3 carbon atoms, or an alkenyl group having 1 to 3 carbon atoms; and R may be substituted with an oxo group, a halogen atom, an alkoxy group, or an acyl group.

The production process of the silica used in the ink-receiving layer is classified into a wet process and a dry process (vapor-phase process). A process for obtaining hydrated silica by producing activated silica through acid decomposition of a silicate, moderately polymerizing the activated silica, and aggregating and settling the resulting polymer is known as the wet process. A process for obtaining anhydrous silica by subjecting silicon halide to high-temperature vapor-phase hydrolysis (flame hydrolysis process) or by vaporizing silica sand and coke by thermal reduction using arc in an electric furnace and oxidizing the resulting product in the air (arc process) is known as the dry process (vapor-phase process). In an embodiment of the present invention, silica (hereafter also referred to as "fumed silica") obtained by the dry process (vapor-phase process) can be used. This is because the fumed silica has a large specific surface area and thus has good ink absorbency, and transparency can be imparted to the ink-receiving layer due to its low refractive index and thus good color development is achieved. Specific examples of the fumed silica include Aerosil (manufactured by Nippon Aerosil Co., Ltd.) and REOLOSIL QS (manufactured by Tokuyama Corporation).

In an embodiment of the present invention, the specific surface area of the fumed silica measured by a BET method is preferably 50 $m^2/g$ or more and 400 $m^2/g$ or less and more preferably 200 $m^2/g$ or more and 350 $m^2/g$ or less.

In an embodiment of the present invention, alumina hydrate, alumina, and silica may be used as a mixture. Specifically, at least two selected from alumina hydrate, alumina, and silica are mixed in the form of powder and dispersed to prepare a dispersion liquid.

(3) Binder

In an embodiment of the present invention, the first ink-receiving layer can further contain a binder. In an embodiment of the present invention, the binder is a material capable of binding inorganic particles.

In an embodiment of the present invention, the content of the binder in the first ink-receiving layer is preferably 5.0 mass % or more and 50.0 mass % or less and more preferably 7.5 mass % or more and 40.0 mass % or less based on the total content of all inorganic particles contained in the first ink-receiving layer. If the content is less than 5.0 mass %, the binding property of the inorganic particles in the ink-receiving layer is not sufficient, which may result in a so-called dusting phenomenon. If the content is more than 50.0 mass %, the ink absorbency of the recording medium is sometimes not sufficiently achieved.

Examples of the binder include starch derivatives such as oxidized starch, etherified starch, and phosphoesterified starch; cellulose derivatives such as carboxymethyl cellulose and hydroxyethyl cellulose; casein, gelatin, soy protein, and polyvinyl alcohol and derivatives thereof; conjugated polymer latexes such as polyvinylpyrrolidone, maleic anhydride resin, styrene-butadiene copolymers, and methyl methacrylate-butadiene copolymers; acrylic polymer latexes such as polymers of acrylates and methacrylates; vinyl polymer latexes such as ethylene-vinyl acetate copolymers; functional group-modified polymer latexes constituted by a monomer of the above-described polymer, the monomer containing a functional group such as a carboxy group; polymers obtained by cationizing the above-described polymer using a cationic group; polymers obtained by cationizing the surface of the above-described polymer using a cationic surfactant; polymers obtained by polymerizing a monomer of the above-described polymer in the presence of a cationic polyvinyl alcohol to distribute the polyvinyl alcohol on the surface of the polymer; polymers obtained by polymerizing a monomer of the above-described polymer in a suspended dispersion liquid of cationic colloidal particles to distribute the cationic colloidal particles on the surface of the polymer; water-based binders such as thermosetting synthetic resin, e.g., melamine resin and urea resin; polymers and copolymers of acrylates and methacrylates, such as polymethyl methacrylate; and synthetic resin such as polyurethane resin, unsaturated polyester resin, vinyl chloride-vinyl acetate copolymers, polyvinyl butyral, and alkyd resin. These binders may be suitably used alone or in combination of two or more.

Among the binders, polyvinyl alcohol and polyvinyl alcohol derivatives are particularly used. Examples of the polyvinyl alcohol derivatives include cationically modified polyvinyl alcohols, anionically modified polyvinyl alcohols, silanol-modified polyvinyl alcohols, and polyvinyl acetal. Among them, polyvinyl alcohol is particularly used in terms of the stability of a coating liquid. Specific examples of the polyvinyl alcohol include PVA235, PVA245, and PVA145 (manufactured by KURARAY Co., Ltd.).

The polyvinyl alcohol can be synthesized by, for example, saponifying polyvinyl acetate. The degree of saponification of the polyvinyl alcohol is preferably 80 mol % or more and 100 mol % or less and more preferably 85 mol % or more and 100 mol % or less. The degree of saponification refers to the mol percent of hydroxy groups generated as a result of a saponification reaction in which polyvinyl alcohol is obtained by saponifying polyvinyl acetate. In an embodiment of the present invention, the degree of saponification is measured in conformity with the method in JIS K 6726. The average degree of polymerization of the polyvinyl alcohol is preferably 1,500 or more and 5,000 or less and more preferably 2,000 or more and 5,000 or less. In an embodiment of the present invention, the average degree of polymerization is a viscosity-average degree of polymerization determined in conformity with the method in JIS K 6726.

When an ink-receiving-layer-forming coating liquid is prepared, the polyvinyl alcohol or the polyvinyl alcohol derivative is used, for example, in the form of an aqueous solution. The solid content of the polyvinyl alcohol or the polyvinyl alcohol derivative in the aqueous solution is, for example, 3 mass % or more and 20 mass % or less.

(4) Cross-Linking Agent

In an embodiment of the present invention, the first ink-receiving layer may further contain a cross-linking agent. Examples of the cross-linking agent include aldehyde compounds, melamine compounds, isocyanate compounds, zirconium compounds, amide compounds, aluminum compounds, boric acid, and borates. These cross-linking agents may be suitably used alone or in combination of two or more. In particular, when polyvinyl alcohol or a polyvinyl alcohol derivative is used as the binder, boric acid or a borate is particularly used among the above-mentioned cross-linking agents.

Examples of the boric acid include orthoboric acid ($H_3BO_3$), metaboric acid, and diboric acid. The borate is, for example, a water-soluble salt of the boric acid. Examples of the borate include alkali metal salts of boric acid such as sodium borate and potassium borate; alkaline-earth metal salts of boric acid such as magnesium borate and calcium borate; and ammonium salts of boric acid. Among them, orthoboric acid is particularly used to achieve good stability of a coating liquid over time and suppress formation of cracks.

(5) Other Additives

In an embodiment of the present invention, the first ink-receiving layer may contain additives other than the above-described additives. Specific examples of the additives include a pH adjusting agent, a thickener, a flow modifier, an antifoaming agent, a foam inhibitor, a surfactant, a mold-release agent, a penetrant, a color pigment, a color dye, a fluorescent brightening agent, an ultraviolet absorber, an antioxidant, a preservative, a fungicide, a water resistance improver, a dye fixative, a curing agent, and a weather resistant material.

Lower Layer: Second Ink-Receiving Layer

In an embodiment of the present invention, a second ink-receiving layer containing inorganic particles having an average particle size of 50 nm or less needs to be disposed between the substrate and the first ink-receiving layer. The thickness of the second ink-receiving layer is, for example, 3 μm or more and 55 μm or less. The coating amount of the second ink-receiving layer is, for example, 3 $g/m^2$ or more and 55 $g/m^2$ or less.

(1) Inorganic Particle

In an embodiment of the present invention, for example, the second ink-receiving layer contains inorganic particles having an average particle size of 50 nm or less (hereafter also simply referred to as "inorganic particles"). The average particle size of the inorganic particles is preferably 1 nm or more and 50 nm or less, more preferably 3 nm or more and 30 nm or less, and particularly preferably 5 nm or more and 20 nm or less. In an embodiment of the present invention, the "average particle size of the inorganic particles" refers to an "average primary particle size of the inorganic particles".

In an embodiment of the present invention, the inorganic particles can be used for an ink-receiving-layer-forming coating liquid while being dispersed by a dispersant. The average secondary particle size of the inorganic particles in a dispersed state is preferably 1 nm or more and 1000 nm or less, more preferably 10 nm or more and 800 nm or less, and particularly preferably 50 nm or more and 500 nm or less. The average secondary particle size of the inorganic particles in a dispersed state can be measured by a dynamic light scattering method. Specifically, the same inorganic particles as those exemplified in the first ink-receiving layer can be used.

In an embodiment of the present invention, the content of the inorganic particles having an average particle size of 50 nm or less in the second ink-receiving layer is, for example, 90 mass % or more based on the total content of all inorganic particles.

(2) Binder

In an embodiment of the present invention, the second ink-receiving layer can further contain a binder. In an embodiment of the present invention, the content of the binder in the second ink-receiving layer is preferably 3.0 mass % or more and 30.0 mass % or less and more preferably 5.0 mass % or more and 25.0 mass % or less based on the content of the inorganic particles in terms of ink absorbency.

The same binder as that exemplified in the first ink-receiving layer can be used. Among them, polyvinyl alcohol is particularly used as the binder for the second ink-receiving layer.

(3) Cross-Linking Agent

In an embodiment of the present invention, the second ink-receiving layer can further contain a cross-linking agent. The addition of the cross-linking agent can prevent formation of cracks in a receiving layer in the production process and can improve the absorbency of printing ink.

The content of the cross-linking agent in the second ink-receiving layer is preferably 1 mass % or more and 60 mass % or less and more preferably 5 mass % or more and 50 mass % or less based on the content of the binder.

Examples of the cross-linking agent include aldehyde compounds, melamine compounds, isocyanate compounds, zirconium compounds, amide compounds, aluminum compounds, boric acid, and borates. These cross-linking agents may be suitably used alone or in combination of two or more. In particular, when polyvinyl alcohol or a polyvinyl alcohol derivative is used as the binder, boric acid or a borate is particularly used among the above-mentioned cross-linking agents.

Examples of the boric acid include orthoboric acid ($H_3BO_3$), metaboric acid, and diboric acid. The borate is, for example, a water-soluble salt of the boric acid. Examples of the borate include alkali metal salts of boric acid such as sodium borate and potassium borate; alkaline-earth metal salts of boric acid such as magnesium borate and calcium borate; and ammonium salts of boric acid. Among them, orthoboric acid is particularly used to achieve good stability of a coating liquid over time and suppress formation of cracks.

(4) Other Additives

In an embodiment of the present invention, the second ink-receiving layer may contain the same additives as those exemplified in the first ink-receiving layer.

Top Layer Containing Colloidal Silica

In an embodiment of the present invention, the recording medium desirably includes a top layer containing colloidal silica in terms of scratch resistance. Spherical colloidal silica is particularly used because high scratch resistance is achieved, and the transparency is improved and thus the color development of an image is improved. The term "spherical" used herein means that, when 50 or more and 100 or less colloidal silica particles are observed with a scanning electron microscope, the ratio b/a of the average minor axis b to the average major axis a of the colloidal silica particles is in the range of 0.80 or more and 1.00 or less. The ratio b/a is preferably 0.90 or more and 1.00 or less and more preferably 0.95 or more and 1.00 or less. Furthermore, spherical cationic colloidal silica is particularly used. Specific examples of the spherical cationic colloidal silica include SNOWTEX AK and SNOWTEX AK-L (manufactured by Nissan Chemical Industries, Ltd.).

The average primary particle size of the colloidal silica is, for example, 30 nm or more and 100 nm or less. If the average particle size is less than 30 nm, an effect of improving ink absorbency is sometimes not sufficiently produced. If the average particle size is more than 100 nm, the transparency degrades and an effect of improving the color development of an image formed is sometimes not sufficiently produced.

The coating amount of the top layer is preferably 0.2 $g/m^2$ or more and 3.0 $g/m^2$ or less and more preferably 0.2 $g/m^2$ or more and 2.0 $g/m^2$ or less. If the coating amount is less than 0.2 $g/m^2$, an effect of improving the binding property of the ink-receiving layer is sometimes not sufficiently produced. If the coating amount is more than 3.0 $g/m^2$, an effect of improving the matte appearance is sometimes not sufficiently produced. The coating thickness of the top layer is preferably 0.2 μm or more and 3.0 μm or less and more preferably 0.2 μm or more and 2.0 μm or less. The root-mean-square slope RΔq of roughness profile elements, provided in JIS B 0601:2001, of the surface of the top layer is, for example, 0.3 or more. If the root-mean-square slope RΔq is less than 0.3, an effect of improving the matte appearance is sometimes not sufficiently produced.

In the top layer, the same binder and cross-linking agent as those exemplified in the above-described ink-receiving layer can be used. The same type of binder contained in the ink-receiving layer may be used or different types of binders may be used.

The top layer may contain a wet-process silica having an average secondary particle size of 1 μm or more. The content of the wet-process silica is preferably 50.0 mass % or less and more preferably 40.0 mass % or less based on the content of the inorganic particles in the top layer.

Method for Producing Recording Medium

In an embodiment of the present invention, a method for producing a recording medium is not particularly limited, but desirably includes a step of preparing an ink-receiving-layer-forming coating liquid and a step of applying the ink-receiving-layer-forming coating liquid onto a substrate. Hereafter, the method for producing a recording medium will be described.

Method for Making Substrate

In an embodiment of the present invention, the base paper can be made by a typically used paper-making method. A paper machine is, for example, a Fourdrinier machine, a cylinder machine, a drum paper machine, a twin-wire former, or the like. In order to improve the surface smoothness of the base paper, a surface treatment may be performed by applying heat and a pressure during or after the paper-making process. Specific examples of the surface treatment include a calender treatment such as machine calendering or supercalendering.

A method for forming a resin layer on a base paper, that is, a method for coating a base paper with a resin may be a melt extrusion method, wet lamination, or dry lamination. Among these methods, a melt extrusion method is particularly employed in which a molten resin is extruded on one surface or both surfaces of a base paper to coat the base paper with the resin. An example of a widely employed method is a method (also referred to as an "extrusion coating method") including bringing a resin extruded from an extrusion die into contact with a conveyed base paper at a nip point between a nip roller and a cooling roller, and pressure-bonding the resin and the base paper with a nip to laminate the base paper with a resin layer. In the formation of a resin layer by the melt extrusion method, a pretreatment may be conducted so that the base paper and the resin layer more firmly adhere to each other. Examples of the pretreatment include an acid etching treatment with a mixture of sulfuric acid and chromic acid, a flame treatment with a gas flame, an ultraviolet irradiation treatment, a corona discharge treatment, a glow discharge treatment, and an anchor coating treatment with an alkyl titanate or the like. Among these pretreatments, a corona discharge treatment is particularly employed.

By pressing a surface of the resin-coated substrate against a roll having particular irregularities, the surface profile of the resin-coated paper can be controlled.

Method for Forming Ink-Receiving Layer

An ink-receiving layer of a recording medium according to an embodiment of the present invention can be formed on a substrate by, for example, the following method. First, an ink-receiving-layer-forming coating liquid is prepared. Then, the coating liquid is applied onto a substrate and dried to produce a recording medium according to an embodiment of the present invention. The coating liquid can be applied with a curtain coater, an extrusion coater, or a slide hopper coater. The coating liquid may be heated during the application. The coating liquid may be dried using a hot-air dryer such as a linear tunnel dryer, an arch dryer, an air loop dryer, or a sine-curve air float dryer; or an infrared dryer, a heating dryer, or a microwave dryer.

EXAMPLES

Hereafter, the present invention will be further described in detail using Examples and Comparative Examples. The present invention is not limited to Examples described below as long as it does not exceed the gist of the present invention. Note that the term "part" in the description of Examples below is on a mass basis unless otherwise specified.

Production of Recording Medium

Preparation of Substrate

Eighty parts of LBKP having a Canadian Standard Freeness of 450 mL CSF, 20 parts of NBKP having a Canadian Standard Freeness of 480 mL CSF, 0.60 parts of cationized starch, 10 parts of heavy calcium carbonate, 15 parts of light calcium carbonate, 0.10 parts of an alkyl ketene dimer, and 0.030 parts of cationic polyacrylamide were mixed with each other. Water was added to the resulting mixture such that the mixture had a solid content of 3.0 mass %, thereby preparing a paper material. Subsequently, the paper material was subjected to paper making with a Fourdrinier machine and three-stage wet pressing, followed by drying with a multi-cylinder dryer. The resulting paper was then impregnated with an aqueous solution of oxidized starch using a size press machine so as to have a solid content of 1.0 g/m$^2$ after drying, and then dried. Furthermore, the paper was subjected to machine calender finishing, thus preparing a base paper having a basis weight of 110 g/m$^2$, a Stockigt sizing degree of 100 seconds, an air permeability of 50 seconds, a Bekk smoothness of 30 seconds, a Gurley stiffness of 11.0 mN, and a thickness of 120 μm. Subsequently, a resin composition containing 70 parts of low-density polyethylene, 20 parts of high-density polyethylene, and 10 parts of titanium oxide was applied onto one surface of the base paper such that the dry coating amount was 25 g/m$^2$. This surface is referred to as a "main surface" of a substrate. By pressing the main surface against a roll having fine irregularities, RΔq of the surface of the resin-coated paper was adjusted to 0.4. Furthermore, a resin composition containing 50 parts of low-density polyethylene and 50 parts of high-density polyethylene was applied onto another surface of the base paper to prepare a substrate.

Preparation of Second-Ink-Receiving-Layer-Forming Coating Liquid

Alumina hydrate DISPERAL HP14 (manufactured by Sasol Limited, average particle size: 14 nm) was added to ion-exchanged water so as to have a solid content of 25 mass %. Subsequently, 1.4 parts of methanesulfonic acid was added to 100 parts of the alumina hydrate in terms of solid content, and stirring was performed. Furthermore, ion-exchanged water was added thereto so that the solid content of the alumina hydrate was 21 mass %. Thus, an alumina hydrate dispersion liquid was prepared.

The alumina hydrate dispersion liquid prepared above, a polyvinyl alcohol aqueous solution (solid content of PVA235 (manufactured by KURARAY Co., Ltd.): 8 mass %), and a boric acid aqueous solution (solid content: 3 mass %) were mixed with each other at a solid content ratio (alumina hydrate:polyvinyl alcohol:boric acid) of 100:10:2 to prepare a second-ink-receiving-layer-forming coating liquid.

Preparation of First-Ink-Receiving-Layer-Forming Coating Liquid

Amorphous silica (wet silica, average particle size: 6 μm) was added to ion-exchanged water so as to have a solid content of 25 mass %. Subsequently, 5.0 parts of polydiallyldimethylammonium chloride polymer was added to 100 parts of the amorphous silica in terms of solid content, and stirring was performed to obtain an amorphous silica dispersion body. The amorphous silica dispersion body and alumina hydrate DISPERAL HP14 were then mixed with each other so that the ratio of the amorphous silica and the alumina hydrate was a ratio listed in Table 1. Subsequently, ion-exchanged water was added to the resulting mixture so that the total solid content of the amorphous silica and the alumina hydrate was 15 mass %. Thus, an inorganic particle dispersion liquid was prepared.

TABLE 1

Preparation conditions of inorganic particle dispersion liquid

| Dispersion liquid No. | Ratio (amorphous silica:alumina hydrate) |
|---|---|
| Dispersion liquid 1-1 | 80:20 |
| Dispersion liquid 1-2 | 0:100 |
| Dispersion liquid 1-3 | 30:70 |
| Dispersion liquid 1-4 | 55:45 |
| Dispersion liquid 1-5 | 60:40 |
| Dispersion liquid 1-6 | 90:10 |
| Dispersion liquid 1-7 | 95:5 |
| Dispersion liquid 1-8 | 100:0 |

The prepared inorganic particle dispersion liquid, a polyvinyl alcohol aqueous solution, and a boric acid aqueous solution (solid content: 3 mass %) were mixed with each other at a solid content ratio (all inorganic particles:polyvinyl alcohol:boric acid) listed in Table 2 to prepare a first-ink-receiving-layer-forming coating liquid. In the type of binder in Table 2, "R-1130" represents a silanol-modified polyvinyl alcohol aqueous solution (prepared by adjusting the solid content of R-1130 (manufactured by KURARAY Co., Ltd.) to 8 mass %) and "PVA235" represents a polyvinyl alcohol aqueous solution (prepared by adjusting the solid content of PVA235 (manufactured by KURARAY Co., Ltd.) to 8 mass %). Table 2 also shows the average particle size of the amorphous silica measured by the above-described method.

TABLE 2

Preparation conditions of first-ink-receiving-layer-forming coating liquid

| Coating liquid No. | Type of inorganic particle dispersion liquid | Type of binder | Ratio (all inorganic particles:binder:boric acid) |
|---|---|---|---|
| Coating liquid 1-1 | Dispersion liquid 1-1 | R1130 | 100:30:0.32 |
| Coating liquid 1-2 | Dispersion liquid 1-2 | R1130 | 100:11:1.60 |
| Coating liquid 1-3 | Dispersion liquid 1-3 | R1130 | 100:16:1.12 |
| Coating liquid 1-4 | Dispersion liquid 1-4 | R1130 | 100:24:0.72 |
| Coating liquid 1-5 | Dispersion liquid 1-5 | R1130 | 100:25:0.64 |
| Coating liquid 1-6 | Dispersion liquid 1-6 | R1130 | 100:33:0.16 |
| Coating liquid 1-7 | Dispersion liquid 1-7 | R1130 | 100:34:0.08 |
| Coating liquid 1-8 | Dispersion liquid 1-8 | R1130 | 100:35:0 |
| Coating liquid 1-9 | Dispersion liquid 1-1 | R1130 | 100:25:0.32 |
| Coating liquid 1-10 | Dispersion liquid 1-1 | R1130 | 100:40:0.32 |
| Coating liquid 1-11 | Dispersion liquid 1-1 | R1130 | 100:50:0.32 |
| Coating liquid 1-12 | Dispersion liquid 1-1 | PVA235 | 100:14:0.32 |
| Coating liquid 1-13 | Dispersion liquid 1-2 | PVA235 | 100:11:1.60 |
| Coating liquid 1-14 | Dispersion liquid 1-3 | PVA235 | 100:12:1.12 |
| Coating liquid 1-15 | Dispersion liquid 1-4 | PVA235 | 100:13:0.72 |
| Coating liquid 1-16 | Dispersion liquid 1-5 | PVA235 | 100:13:0.64 |
| Coating liquid 1-17 | Dispersion liquid 1-6 | PVA235 | 100:15:0.16 |
| Coating liquid 1-18 | Dispersion liquid 1-7 | PVA235 | 100:15:0.08 |
| Coating liquid 1-19 | Dispersion liquid 1-8 | PVA235 | 100:15:0 |
| Coating liquid 1-20 | Dispersion liquid 1-1 | PVA235 | 100:13:0.32 |
| Coating liquid 1-21 | Dispersion liquid 1-1 | PVA235 | 100:20:0.32 |
| Coating liquid 1-22 | Dispersion liquid 1-1 | PVA235 | 100:30:0.32 |

Preparation of Top-Layer-Forming Coating Liquid

A colloidal silica dispersion liquid (SNOWTEX AK-L, manufactured by Nissan Chemical Industries, Ltd.), a silanol-modified polyvinyl alcohol aqueous solution (solid content of R-1130 (manufactured by KURARAY Co., Ltd.): 8 mass %), and a boric acid aqueous solution (solid content: 3 mass %) were mixed with each other at a solid content ratio (amorphous silica:polyvinyl alcohol:boric acid) of 100:11:1.2 to prepare a top-layer-forming coating liquid.

Production of Recording Medium

The prepared second-ink-receiving-layer-forming coating liquid, first-ink-receiving-layer-forming coating liquid, and top-layer-forming coating liquid (temperature of each coating liquid: 40° C.) were subjected to simultaneous multilayer application onto a substrate using a slide die at a dry coating amount (g/m$^2$) listed in Table 3 and dried with hot air at 150° C. to produce each recording medium.

Evaluation

Matte Appearance of Surface of Recording Medium

The specular glossiness, provided in JIS Z 8741, of the produced recording medium was measured at 20°, 60°, and 75° using a gloss meter VG2000 (manufactured by Nippon Denshoku Industries Co., Ltd.). The measurement was performed at freely selected five points on the surface of the recording medium, and the average was calculated. The matte appearance on the surface of the recording medium was evaluated from the measured specular glossiness. The evaluation criteria are as follows. Table 3 shows the evaluation results.

A: The maximum specular glossiness at 20°, 60°, and 75° was less than 2.6%.

B: The maximum specular glossiness at 20°, 60°, and 75° was 2.6% or more and less than 6.0%.

C: The maximum specular glossiness at 20°, 60°, and 75° was 6.0% or more.

Binding Property of Ink-Receiving Layer

A black sheet was placed on the produced recording medium. The black sheet was pulled by 10 cm at a constant speed while a load of 15 g/cm$^2$ was applied to the black sheet. The adhesion amount of powder to the black sheet was evaluated as a residual percentage of the black optical density of the black sheet ((black optical density before powder adhesion−black optical density after powder adhesion)/black optical density before powder adhesion). The optical density was measured with an optical reflection densitometer (trade name: 530 spectro-densitometer, manufactured by X-Rite). The binding property of the ink-receiving layer of the recording medium was evaluated from the measured residual percentage of the optical density. The evaluation criteria are as follows. Table 3 shows the evaluation results.

A: The residual percentage of the optical density was more than 90%.

B: The residual percentage of the optical density was more than 75% and 90% or less.

C: The residual percentage of the optical density was 75% or less.

Color Development of Image Formed

A black solid pattern was printed on a recording surface of each of the produced recording media using an ink jet printer (trade name: MG8230, manufactured by CANON KABUSHIKI KAISHA) in a mode for photo paper (gloss gold) without color correction. The optical density was measured with an optical reflection densitometer (trade name: 530 spectro-densitometer, manufactured by X-Rite). The color development of an image formed was evaluated from the measured optical density. The evaluation criteria are as follows. Table 3 shows the evaluation results.

AA: 1.80 or more

A: 1.70 or more and less than 1.80

B: 1.60 or more and less than 1.70

C: less than 1.60

TABLE 3

Production conditions and evaluation results of recording medium

| | | First ink-receiving layer | | Second ink-receiving layer | Top layer | | Evaluation result: Matte appearance | Evaluation result: Binding property | |
|---|---|---|---|---|---|---|---|---|---|
| Example No. | Recording medium No. | Type of coating liquid | Coating amount ($g/m^2$) | Coating amount ($g/m^2$) | Coating amount ($g/m^2$) | Coating thickness (μm) | of surface of recording medium | of ink-receiving layer | Color development of image |
| Example 1 | Recording medium 1 | Coating liquid 1-3 | 5.0 | 25.0 | — | — | A | B | B |
| Example 2 | Recording medium 2 | Coating liquid 1-4 | 5.0 | 25.0 | — | — | A | B | A |
| Example 3 | Recording medium 3 | Coating liquid 1-5 | 5.0 | 25.0 | — | — | A | B | AA |
| Example 4 | Recording medium 4 | Coating liquid 1-1 | 5.0 | 25.0 | — | — | A | B | AA |
| Example 5 | Recording medium 5 | Coating liquid 1-6 | 5.0 | 25.0 | — | — | A | B | AA |
| Example 6 | Recording medium 6 | Coating liquid 1-7 | 5.0 | 25.0 | — | — | A | B | A |
| Example 7 | Recording medium 7 | Coating liquid 1-9 | 5.0 | 25.0 | — | — | A | B | AA |
| Example 8 | Recording medium 8 | Coating liquid 1-10 | 5.0 | 25.0 | — | — | A | A | AA |
| Example 9 | Recording medium 9 | Coating liquid 1-11 | 5.0 | 25.0 | — | — | A | A | A |
| Example 10 | Recording medium 10 | Coating liquid 1-1 | 15.0 | 15.0 | — | — | A | B | A |
| Example 11 | Recording medium 11 | Coating liquid 1-1 | 10.0 | 15.0 | — | — | A | B | AA |
| Example 12 | Recording medium 12 | Coating liquid 1-1 | 1.0 | 29.0 | — | — | A | B | AA |
| Example 13 | Recording medium 13 | Coating liquid 1-1 | 0.7 | 29.3 | — | — | B | B | AA |
| Example 14 | Recording medium 14 | Coating liquid 1-1 | 5.0 | 25.0 | 1.0 | 1.0 | A | A | AA |
| Comparative Example 1 | Recording medium 15 | Coating liquid 1-1 | 5.0 | — | — | — | A | B | C |
| Comparative Example 2 | Recording medium 16 | Coating liquid 1-2 | 5.0 | 25.0 | — | — | C | A | AA |
| Comparative Example 3 | Recording medium 17 | Coating liquid 1-8 | 5.0 | 25.0 | — | — | A | C | B |
| Example 15 | Recording medium 18 | Coating liquid 1-14 | 5.0 | 25.0 | — | — | A | B | B |
| Example 16 | Recording medium 19 | Coating liquid 1-15 | 5.0 | 25.0 | — | — | A | B | A |
| Example 17 | Recording medium 20 | Coating liquid 1-16 | 5.0 | 25.0 | — | — | A | B | AA |
| Example 18 | Recording medium 21 | Coating liquid 1-12 | 5.0 | 25.0 | — | — | A | B | AA |
| Example 19 | Recording medium 22 | Coating liquid 1-17 | 5.0 | 25.0 | — | — | A | B | AA |
| Example 20 | Recording medium 23 | Coating liquid 1-18 | 5.0 | 25.0 | — | — | A | B | A |
| Example 21 | Recording medium 24 | Coating liquid 1-20 | 5.0 | 25.0 | — | — | A | B | AA |
| Example 22 | Recording medium 25 | Coating liquid 1-21 | 5.0 | 25.0 | — | — | A | A | AA |
| Example 23 | Recording medium 26 | Coating liquid 1-22 | 5.0 | 25.0 | — | — | A | A | A |
| Example 24 | Recording medium 27 | Coating liquid 1-12 | 15.0 | 15.0 | — | — | A | B | A |
| Example 25 | Recording medium 28 | Coating liquid 1-12 | 10.0 | 15.0 | — | — | A | B | AA |
| Example 26 | Recording medium 29 | Coating liquid 1-12 | 1.0 | 29.0 | — | — | A | B | AA |
| Example 27 | Recording medium 30 | Coating liquid 1-12 | 0.7 | 29.3 | — | — | B | B | AA |
| Example 28 | Recording medium 31 | Coating liquid 1-12 | 5.0 | 25.0 | 1.0 | 1.0 | A | A | AA |
| Comparative Example 4 | Recording medium 32 | Coating liquid 1-12 | 5.0 | — | — | — | A | B | C |
| Comparative Example 5 | Recording medium 33 | Coating liquid 1-13 | 5.0 | 25.0 | — | — | C | A | AA |
| Comparative Example 6 | Recording medium 34 | Coating liquid 1-19 | 5.0 | 25.0 | — | — | A | C | B |

While the present invention has been described with reference to exemplary embodiments, it is to be understood that the invention is not limited to the disclosed exemplary embodiments. The scope of the following claims is to be accorded the broadest interpretation so as to encompass all such modifications and equivalent structures and functions.

This application claims the benefit of Japanese Patent Application No. 2014-194374, filed Sep. 24, 2014, which is hereby incorporated by reference herein in its entirety.

What is claimed is:

1. A recording medium comprising:

a substrate; and an ink-receiving layer, wherein the ink-receiving layer comprises a second ink-receiving layer containing inorganic particles having an average particle size of 50 nm or less and a first ink-receiving layer containing an amorphous silica having an average secondary particle size of 1.0 μm or more and inorganic particles having an average primary particle size of 50 nm or less, in this order from the substrate, and a content of the amorphous silica in the first ink-receiving layer is 30 mass % or more and 95 mass % or less based on a total content of all inorganic particles in the first ink-receiving layer.

2. The recording medium according to claim 1, wherein the substrate is a resin-coated substrate.

3. The recording medium according to claim 1, wherein the amorphous silica is a wet-process silica.

4. The recording medium according to claim 1, wherein the amorphous silica in the first ink-receiving layer has a secondary average particle size of 1.0 μm or more and 10.0 μm or less.

5. The recording medium according to claim 1, further comprising a top layer comprising a colloidal silica on a top surface of the ink-receiving layer.

6. The recording medium according to claim 5, wherein a coating amount of the top layer is 0.2 $g/m^2$ or more and 3.0 $g/m^2$ or less.

7. The recording medium according to claim 5, wherein the top layer has a thickness of 0.2 μm or more and 3.0 μm or less.

8. The recording medium according to claim 5, wherein a root-mean-square slope RΔq of roughness profile elements of a surface of the top layer is 0.3 or more.

9. The recording medium according to claim 1, wherein the content of the amorphous silica in the first ink-receiving layer is 55 mass % or more and 95 mass % or less based on the total content of all inorganic particles in the first ink-receiving layer.

10. The recording medium according to claim 1, wherein the content of the amorphous silica in the first ink-receiving layer is 60 mass % or more and 90 mass % or less based on the total content of all inorganic particles in the first ink receiving layer.

11. The recording medium according to claim 1, wherein the inorganic particles of the first ink-receiving layer have an average primary particle size of 1 nm or more and 50 nm or less.

12. The recording medium according to claim 1, wherein the inorganic particles of the first ink-receiving layer have an average primary particle size of 3 nm or more and 30 nm or less.

13. The recording medium according to claim 1, wherein the inorganic particles in the first ink-receiving layer are an alumina hydrate.

14. The recording medium according to claim 1, wherein the first ink-receiving layer comprises a binder.

15. The recording medium according to claim 14, wherein a content of the binder in the first ink-receiving layer is 5.0 mass % or more and 50.0 mass % or less based on the total content of all inorganic particles in the first ink-receiving layer.

16. The recording medium according to claim 1, wherein the inorganic particles in the second ink-receiving layer have an average primary particle size of 1 nm or more and 50 nm or less.

17. The recording medium according to claim 1, wherein the inorganic particles in the second ink-receiving layer have an average primary particle size of 3 nm or more and 30 nm or less.

18. The recording medium according to claim 1, wherein a content of the inorganic particles in the second ink-receiving layer is 90 mass % or more based on the total content of all inorganic particles in the second ink-receiving layer.

19. The recording medium according to claim 1, wherein the inorganic particles in the second ink-receiving layer are an alumina hydrate.

* * * * *